United States Patent [19]

Kemp

[11] 4,251,383

[45] Feb. 17, 1981

[54] SOAP AND DETERGENT CLEANING COMPOSITIONS CONTAINING EUCALYPTUS OIL

[76] Inventor: Frederick W. Kemp, 36 Lyell Parade, Greensborough 3088, Victoria, Australia

[21] Appl. No.: 42,327

[22] Filed: May 25, 1979

[30] Foreign Application Priority Data

Jun. 7, 1978 [AU] Australia ..... PD4626
Mar. 29, 1979 [AU] Australia ..... PD8237

[51] Int. Cl.[3] ..... C11D 3/60; C11D 9/60
[52] U.S. Cl. ..... 252/118; 252/89.1; 252/153; 252/162; 252/170; 252/548
[58] Field of Search ..... 252/89.1, 170, 548, 252/153, 118, 122, 162

[56] References Cited

U.S. PATENT DOCUMENTS

| | | | |
|---|---|---|---|
| 1,006,736 | 10/1911 | Ellis | 252/122 |
| 2,374,113 | 4/1945 | Lowe | 252/118 |
| 3,360,476 | 12/1967 | Krusius | 252/107 |
| 3,634,338 | 1/1972 | Laugle et al. | 252/118 X |
| 3,900,407 | 8/1975 | Kaufman | 252/122 X |
| 4,079,078 | 3/1978 | Collins | 252/143 X |
| 4,123,378 | 10/1978 | Abel et al. | 252/89.1 X |

*Primary Examiner*—Harris A. Pitlick

[57] ABSTRACT

A soap or detergent additive composition comprising a blend of an effective amount of (a) an essential oil (b) a detergent composition which includes an anionic, cationic or non-ionic surfactant or mixtures thereof, and (c) a softening agent which comprises a fixed oil derivative.

13 Claims, No Drawings

SOAP AND DETERGENT CLEANING COMPOSITIONS CONTAINING EUCALYPTUS OIL

This invention relates to cleaning compositions, in particular detergents and soaps, for removing extraneous material such as dirt, varnish, stains and the like from fabrics, metals, plastics, natural fibres or other materials.

Although various detergent compositions are known for cleaning of materials, there remains a need for a composition capable of removing quantities of dirt, varnish stains and like foreign matter which is both economic and not harmful to the materials to be cleaned. Stripping compositions for varnish, paint and the like are known but generally these are harmful to the surfaces to be cleaned.

An object of the present invention is to provide a soap or detergent composition capable of removing materials such as dirt, varnish and stains and the like from surfaces without harm to the materials. The object of the present invention is achieved by incorporating into soap or detergent compositions an additive composition.

According to the present invention there is provided a soap or detergent additive composition comprising a blend of (1) an essential oil, (2) a detergent composition which includes an anionic, cationic or nonionic surfactant or mixtures thereof, and (3) a softening agent which comprises a fixed oil derivative. Such a composition is suitable for the preparation of multi-purpose soap compositions or liquid detergent compositions.

It has also been surprisingly found that particularly effective results are achieved with compositions wherein the essential oil is present as the major active component, preferably in the range of about 46 to 70% by volume. These additive compositions may also be used in the preparation of soaps or detergents which are suitable for cleansing treatments of natural fibres such as wool or for cleaning metals, particularly aluminum.

The soap or detergent additive compositions according to the present invention include one or more detergent components. Any suitable detergent may be used including anionic, cationic or nonionic detergents and mixtures thereof. The anionic, cationic and nonionic detergents include anionic, cationic and nonionic surfactants, respectively. A suitable anionic detergent is a sulfuric acid detergent known under the trade name SSA/005 which is a 60% active detergent. An alternative preferred detergent is that known under the trade name SSAL, available from Albright and Wilson, Melbourne.

The additive compositions of the present invention also include an essential oil component, particularly an eucalyptus oil. Any suitable eucalyptus oil may be used, preferably as a 35–90% solution, and a suitable example is that obtained as industrial grade which is approximately a 35–40% solution.

The additive composition also includes a fixed oil derivative component as a softener and more preferably a diethanolamide derivative is used for the purpose. Preferably cocoanut oil is used. Cocoanut oil contains approximately 48% lauric acid. Particularly preferred is Cocoanut diethanolamide which is available under the trade name, Decolamide FAG from Streetly Chemicals or under the trade name, Teric CDE from ICI Ltd. These agents are characterised in that they have high free diethanolamine contents. A particularly preferred composition comprises about 1 to 25% by volume detergent, about 47 to 70% essential oil and from 5 to 25% softening agent.

The additive composition of the present invention may optionally also include an alkali metal salt in the form of a brine solution. The preferred salt is sodium chloride. The brine solution may be prepared by adding the salt (such as sodium chloride) to water, boiling the resultant solution, for example, approximately twenty minutes, straining the solution, allowing the solution to cool to approximately room temperature, reboiling the solution for e.g. about twenty minutes, straining the solution, and then allowing the solution to cool to room temperature.

A brine solution of up to 10% salt may be used but as the upper limits of this concentration are approached, the problem known in the art as "fall out" or "salt precipitation" may be encountered. A 5% solution has been found to be more satisfactory as this problem is not encountered.

The additive composition according to the invention may also optionally include an aliphatic alcohol component. Although any suitable alcohol may be used, commercially available ethyl alcohol in the form of "methylated spirits" is preferred for economic reasons.

It will be appreciated that the components indicated above for the additive compositions which include alcohol and an alkali metal salt solution are not mutually miscible and the composition will thus be provided in the form of an emulsion. The composition should therefore be shaken prior to use to ensure even distribution of components throughout the composition. Alternatively an emulsifying agent may be used, e.g. "Kemmotan T20" available from Streetley Chemicals. Kemmotan T20 is a sorbitol ester emulsifying agent with a hydroxyl value in the range 96–100.

The additive composition previously described may be used in any suitable form as would be understood by the art. For example, the additive composition may be included in known soap compositions and these may be prepared in any form, e.g. in tablet, flake or powder form. Alternatively the additive composition may be included in a liquid detergent composition or concentrate in known manner.

The additive composition may be prepared, for example, in the following manner. Essential oil is placed in a container, the detergent is added and mixed in the container and left for a short period, e.g. five minutes. The fixed oil component is added and again mixed in. Where an alkali metal salt (brine) solution and aliphatic alcohol are to be used, these should be added prior to the fixed oil component. This forms an additive composition blend which may be used in the preparation of a soap by mixture with a soap base composition comprising an alkali metal hydroxide, water and a fatty acid source. A preferred fatty acid source is a composition which comprises 50% Mutton Fat and 50% Beef Fat but any other source of fatty acids may be used. Particularly preferred, for wool treatment, is a change composition which comprises 100% Beef Fat. The blend may comprise from about 3 to about 35% by weight of the final product, preferably about 5 to about 10 wt.%.

A liquid detergent composition may be prepared by forming a solution or suspension of the soap described in the preceding paragraph in water after crushing said soap. Alternatively a liquid detergent composition may be prepared directly from the additive composition blend prepared as previously described. For example a mixture of a further detergent, water and the blend may be prepared. A suitable detergent is Kitalene 011 available from Lever and Kitchen. Where the water is not included a concentrate is formed.

It will be readily understood that conventional emulsifiers and compounding ingredients may also be included in the liquid detergent and soap compositions. For example, compounding oils, builders, fillers, essences, perfumes, disinfectants, colouring agents, bleaches and/or brightening agents, may be included. For compositions designed for use with natural fibres or for the treatment of metals, pH regulating agents may be included. For example potassium hydroxide has been found to be suitable.

Soap compositions of the invention are characterised by extremely good pH values which make them appropriate for use with natural fibers, e.g. wool. For example, pH's in the range 8.0 to 9.0 may be obtained.

The preferred embodiments of the present invention will now be more fully described by the following non-limiting examples. The examples illustrate the preparation of base compositions and their incorporation in multi-purpose soap compositions and liquid compositions.

EXAMPLE 1

An additive composition blend was prepared with the components as follows:

| Component | % by Volume |
|---|---|
| Detergent | 13.3 |
| Essential Oil | 66.6 |
| Fixed Oil Derivative | 20.0 |
| | 99.9 |

This represents a manufacturing formula as follows:

| Component | Amount (liters) |
|---|---|
| SSAL Detergent | 2.00 |
| Eucalyptus Oil (35–40% solution) | 10.00 |
| Cocoanut Oil Diethanolamide (FAG) | 3.00 |

The components were mixed in the following manner:

The Eucalyptus oil was placed in a container and was added and mixed in. The container was sealed and left for a short period, e.g. five minutes. Cocoanut oil was then added and also mixed in. (a) A soap composition was then prepared with the components as follows:

| Component | Amount |
|---|---|
| Sodium Hydroxide | 3000 gms |
| Fats (100% Beef) | 3000 gms |
| Water | 2 Liters |
| Additive blend | .20–.25 Liters |

The components were mixed in the following manner:

The sodium hydroxide was dissolved in the water and added to an urn (preferably a stainless steel or cast iron container) at approximately the same rate as the Fats. The preparation of the soap mix then followed normal soap manufacturing conditions with stirring and boiling of the soap and separation of lye. (Alternatively the soap may be prepared in accordance with the process described in example 2 following). Once the soap was prepared, the additive blend was mixed in until an even consistency was produced. (b) A liquid detergent composition was then prepared with the components as follows:

| Component | % by Weight |
|---|---|
| Detergent | 13.00 |
| Additive Blend | 5.00 |
| pH regulating agent | 2.50 |
| $H_2O$ | 79.50 |
| | 100.00 |

It will be appreciated that this represents a manufacturing formula as follows:

| Component | Amount (grams) |
|---|---|
| Kitalene Detergent | 117 gms |
| Blend | 45 gms |
| KOH pH adjusting agent | 22.5 gms |
| $H_2O$ | 715.5 gms |
| | 900.0 gms |

The components were mixed in the following manner. The Kitalene was added to an urn (preferably a stainless steel or cast iron container) and warmed. The water and KOH were then added with stirring. Finally the blend is added with further stirring and the composition allowed to cool. This composition was found to be particularly suitable for treatment of aluminum.

EXAMPLE 2

A blend, to be used in the manufacture of a soap, was prepared with the components as follows:

| Component | % by Volume |
|---|---|
| Detergent | 8.89 |
| Eucalyptus Oil (35–40% solution) | 22.22 |
| Fixed Oil Derivative | 13.33 |
| Alkali Metal Salt | 2.78 |
| Water | 52.78 |
| | 100.00 |

This represents a manufacturing formula as follows:

| Component | % by Volume |
|---|---|
| SSAL Detergent | 8.89 |
| Eucalyptus Oil (35–40%) | 22.22 |
| Cocoanut Oil Diethanolamide (FAG) | 13.33 |
| Brine | 55.56 |
| | 100.00 |

The additive blend was mixed as specified above. It has been found that more softener and more detergent (contained surfactant) is required in the blend for soap applications.

A soap composition was then prepared using the blend described above with the components as follows:

| Component | % by Volume |
|---|---|
| Sodium Hydroxide Flakes | 550 gms |
| Fats (Mutton 50%, Beef 50%) | 3000 gms |
| Water | 2 Liters |

-continued

| Component | % by Volume |
|---|---|
| Additive Blend | 1.5 Liters |

The components were mixed in the following manner: Sodium Hydroxide Flakes were added to cold water in an urn (preferably a stainless steel or cast iron container), which was stirred until the flakes were completely dissolved, then allowed to cool. The fats, which had previously been melted and also allowed to cool, were poured slowly into the caustic solution and stirred for a few minutes. Two minutes was found adequate to form an even consistency blend.

When the fats were added to the caustic solution, the soap begins to form. The lye began to separate and fell to the bottom of the container. Because the fatty acids were lighter then the lye, the lye supported the fatty acids. As the lye continued to separate the process of separating the the residual lye slowed.

The mix was allowed to cool until the lye separated from the soap and the soap was only just self-supporting (or gel like). The separated lye was allowed to drain off from the bottom of the urn. It is important that some lye remain as it is required so that the diethanolamide will blend into the soap when the blend is added. The blend prepared as described above was then mixed in until an even consistency was produced. The temperature of the soap was still very hot, but not hot enough to evaporate the essential oil to the extent of spoiling the soap product.

The soap product specified above may be used in many varied cleaning applications, including cleaning ball point pen ink, blood, grass and grease from clothing or carpets. It is particularly useful in the removel of "milk stone". Milk stone is a residue which forms in both stainless steel and plastic pipes used in dairying, brewing and wine-making machinery.

| Component | % by Volume |
|---|---|
| Detergent (100% Active) | 0.60 |
| Essential Oil | 10.00 |
| Alcohol | 63.00 |
| Fixed Oil Derivative | 1.00 |
| Alkali Metal Salt | 2.50 |
| Water | 22.90 |
| | 100.00 |

This represents a manufacturing formula as follows:

| Component | % by Volume |
|---|---|
| SSA/055 Detergent (60% Active) | 1.00 |
| Eucalyptus Oil (35.49%) | 10.00 |
| Industrial Methylated Spirits | 63.00 |
| Cocoanut Oil Diethanolamide (FAG) | 1.00 |
| Brine (10% solution) | 25.00 |
| | 100.00 |

It was found that on mixing and shaking, the composition was useful in cleaning many surfaces which were difficult to clean with other previous compositions. The cleaning composition was found to be particularly useful in the cleaning of stainless steel sinks and other hard surfaces such as glasses and the like. The composition was also applied to a varnished surface and then the surface rubbed with a rag. The varnish was readily removed with the rag. It was found also that, after application of the cleaning composition, the varnish could be removed by rubbing lightly with sandpaper.

EXAMPLE 4

A composition was prepared with the components as follows:

| Component | % by Volume |
|---|---|
| Detergent (100% Active) | 0.60 |
| Essential Oil | 25.00 |
| Alcohol | 63.00 |
| Fixed Oil Derivative | 1.00 |
| Alkali Metal Salt | 1.00 |
| Water | 9.40 |
| | 100.00 |

This represents a manufactuing formula as follows:

| Component | % by Volume |
|---|---|
| SSA/005 Detergent (60% Active) | 1.00 |
| Eucalyptus Oil (35–40% solution) | 25.00 |
| Industrial Methylated Spirits | 63.00 |
| Cocoanut Oil Diethanolamide (FAG) | 1.00 |
| Brine (10%) solution | 10.00 |
| | 100.00 |

Again this composition was found most satisfactory in cleaning many hard surfaces and was also found satisfactory for removal of varnish from wood.

EXAMPLE 5

This example illustrates a detergent composition which does not require shaking prior to use. The composition was prepared with the components as follows:

| Component | % by Volume |
|---|---|
| Detergent | 2.00 |
| Essential Oil | 10.00 |
| Alcohol | 57.00 |
| Fixed Oil Derivative | 3.00 |
| Alkali Metal Salt | 1.25 |
| Water | 23.75 |
| Emulsifying Agent | 3.00 |
| | 100.00 |

This represents a manufacturing formula as follows:

| Component | % by Volume |
|---|---|
| SSAL Detergent | 2.00 |
| Eucalyptus Oil (35–40% solution) | 10.00 |
| Industrial Methylated Spirits | 57.00 |
| Cocoanut Oil Diethanolamide (FAG) | 3.00 |
| Brine (5%) solution | 25.00 |
| Kemmotan T20 | 3.00 |
| | 100.00 |

The components were mixed in the following manner. The eucalyptus oil was placed in the container. SSAL was added and mixed. The container was sealed and left for a short period, e.g. five minutes. Brine was then added and mixed, followed by methylated spirits, cocoanut oil diethanolamide and then Kemmotan T20.

Finally, it is to be understood that various alterations, modifications and/or additions may be introduced into the constructions and arrangements of parts previously described without departing from the spirit or ambit of the invention.

Having now described my invention what I claimed as new and desired to secure by Letters Patent is:

1. A soap or detergent additive composition consisting essentially of a blend of:
(a) 50 to 70% by volume of eucalyptus oil present as a 35 to 90% solution;
(b) 5 to 25% by volume of a coconut oil diethanolamide; and
(c) 1 to 25% by volume of a detergent composition which includes a non ionic, anionic or cationic surfactant.

2. A composition according to claim 1 wherein the eucalyptus oil is present as an approximate 35 to 40% solution.

3. A composition according to claim 2 wherein (b) comprises a coconut oil diethanolamide having a high free diethanolamine content.

4. A composition according to claim 3 wherein there is further included an alkali metal salt in the form of a brine solution containing up to 10% salt, the brine solution being present in an amount of about 10% by volume to about 55% by volume based on the total volume of the composition.

5. A composition according to claim 4 wherein the alkali metal salt is sodium chloride.

6. A composition according to claim 3 wherein there is further included methanol, ethanol or a mixture thereof in an amount of about 57% by volume to about 63% by volume based on the total volume of the composition.

7. A composition according to claim 6 wherein there is further included an emulsifying agent.

8. A process for preparing a soap or detergent additive composition characterized in that eucalyptus oil in a 35 to 90% solution is placed in a container, a detergent composition is added, the detergent composition including a non ionic, anionic or cationic surfactant or mixtures thereof, the container is sealed and the components mixed and the mixture allowed to stand for a period of about 5 minutes, coconut oil diethanolamide is added and the components mixed continuously to form a blend of even consistency; the said blend consisting essentially of 50–70% by volume of eucalyptus oil, 5–25% by volume of coconut oil diethanolamide and 1–25% by volume of the detergent composition.

9. A soap composition comprising a blend of from 3 to 35% by weight of a soap or detergent additive composition according to claim 1 and from 65 to 97% by weight of a soap base which comprises:
(a) an alkali metal hydroxide,
(b) water,
(c) a source of fatty acids.

10. A detergent composition comprising a blend of from 3 to 35% by weight of a soap or detergent additive composition according to claim 1, and from 65 to 97% by weight of a liquid detergent composition comprising an aqueous detergent solution and optionally a pH regulating agent.

11. A composition according to claim 10 wherein the pH regulating agent is potassium hydroxide.

12. A soap composition according to claim 9 wherein the source of fatty acids is a composition which comprises 50% mutton fat and 50% beef fat.

13. A soap composition according to claim 9 wherein the source of fatty acids is a composition which comprises 100% beef fat.

* * * * *